US009038868B2

(12) United States Patent
Poiani

(10) Patent No.: US 9,038,868 B2
(45) Date of Patent: May 26, 2015

(54) TWIN BABY CARRIER

(71) Applicant: Dawn Amber Pitre Poiani, Honolulu, HI (US)

(72) Inventor: Dawn Amber Pitre Poiani, Honolulu, HI (US)

( * ) Notice: Subject to any disclaimer, the term of this patent is extended or adjusted under 35 U.S.C. 154(b) by 8 days.

(21) Appl. No.: 13/913,361

(22) Filed: Jun. 7, 2013

(65) Prior Publication Data

US 2013/0327796 A1 Dec. 12, 2013

Related U.S. Application Data

(60) Provisional application No. 61/657,752, filed on Jun. 9, 2012.

(51) Int. Cl.
*A47D 13/02* (2006.01)

(52) U.S. Cl.
CPC ..... *A47D 13/02* (2013.01); *A47D 13/025* (2013.01)

(58) Field of Classification Search
CPC ..... A47D 13/02; A47D 13/025
USPC ..... 224/158–161
See application file for complete search history.

(56) References Cited

U.S. PATENT DOCUMENTS

| | | | | | |
|---|---|---|---|---|---|
| 4,434,920 | A * | 3/1984 | Moore | 224/160 |
| D307,821 | S * | 5/1990 | Fallon | D3/214 |
| 4,986,458 | A | 1/1991 | Linday | |
| 5,289,959 | A | 3/1994 | Beeley et al. | |
| 5,454,498 | A | 10/1995 | Dunn et al. | |
| 5,848,741 | A * | 12/1998 | Fair | 224/160 |
| 5,961,014 | A * | 10/1999 | Knerr | 224/259 |
| 6,763,983 | B2 * | 7/2004 | Norman | 224/160 |
| 7,322,498 | B2 | 1/2008 | Frost | |
| 2004/0149790 | A1 * | 8/2004 | Kassai et al. | 224/160 |
| 2005/0045674 | A1 * | 3/2005 | Rehbein | 224/160 |
| 2007/0284403 | A1 * | 12/2007 | Minami et al. | 224/160 |
| 2008/0283561 | A1 * | 11/2008 | Parness et al. | 224/160 |
| 2009/0206116 | A1 * | 8/2009 | Grant | 224/160 |
| 2010/0308087 | A1 * | 12/2010 | Lindbloom | 224/160 |
| 2014/0131401 | A1 * | 5/2014 | Workman | 224/160 |

OTHER PUBLICATIONS

Tot Tenders Website, accessed via the Wayback Machine (archived from Jul. 6, 2010).*

(Continued)

*Primary Examiner* — Justin Larson
*Assistant Examiner* — Scott McNurlen
(74) *Attorney, Agent, or Firm* — Goodsill Anderson Quinn & Stifel LLP

(57) ABSTRACT

A soft structured baby carrier designed to carry two babies on wearer at the same time. The carrier includes two individual pouches possessing a top upwardly curved edge, a bottom edge, and two opposing side edges creating a pouch. Each pouch bottom edge is fixed to the top edge of a wide padded hip belt adapted to connect each pouch together and then encircle the lumbar region of hips of wearer. There are two padded shoulder straps that buckle to the pouches and can be conjoined by a chest strap that is slide-able secured connecting each shoulder strap together. There are four carry positions for this carrier. Two babies can be worn on the front of wearer with one baby mounted in each pouch in the Front Carry Position. One baby mounted in one pouch on front of wearer and one baby mounted in one pouch on back of wearer in the Front and Back Carry Position. The carrier can be split into two carriers so one adult can carry one baby in a Pouch each on the front of wearer in the Individual Carry Position. The carrier can also utilize both Shoulder Straps on one Pouch to carry one baby on one wearer in a traditional style soft structure buckled baby carrier in the Single Baby Carry Position.

12 Claims, 13 Drawing Sheets

(56) References Cited

OTHER PUBLICATIONS

Twingo, Home, http://www.twingocarrier.com/, printed Jun. 21, 2013, 2.

Tot Tenders, (Tot Tenders—Life Exists After Birth!), http://www.tottenders.com/products.html, printed Jun. 21, 2013, 2.

Twintrexx.Com, TwinTrexx Twin Baby Carrier, http://www.twintrexx.com/, printed Jun. 21, 2013, 2.

Weego Baby Carrier—Twin, http://www.weego.com/en/produkte/weego_twin.php, printed Jun. 21, 2013, 1.

* cited by examiner

TWIN BABY CARRIER

RELATED APPLICATIONS

This application claims priority to U.S. Provisional Patent Application No. 61/657,752, filed Jun. 9, 2012, and entitled "Twin Baby Carrier" by Dawn Pitre Poiani, which is incorporated herein by reference.

TECHNICAL FIELD

The present invention is in the technical field of baby carriers and more particularly pertains to such carriers specially designed to carry twins or two babies of different ages at the same time.

BACKGROUND

Soft Structured Baby carriers have become very popular in modern day by parents and caregivers so they can wear their baby on their body, which afford the wearer freedom of hand and arm movement, while transporting a baby that is secured in the carrier. Mothers that have more than one baby, that is the same or close in age, at the same time, have not had that luxury until baby carriers for twins evolved. Though such baby carriers have achieved some popularity and commercial success, there has been a continuing need for improvement. In pursuit of child safety, one of the challenges of carriers for twins is making a carrier that is versatile without being complex to use. Another challenge is making the carrier ergonomically supportive and comfortable for the babies spine and hips. And yet another challenge, is distributing the burden of the babies weight on a wearer so that it is comfortable to support the burden of weight of two babies at the same time. Another challenge is making a carry that can grow with the needs of wearer and baby, as babies grow. All of these challenges need to be improved upon without the compromise of the safety. The foregoing examples of the related art and limitations related therewith are intended to be illustrative and not exclusive. Other limitations of the related art will become apparent upon a reading of the specification and a study of the drawings.

SUMMARY

The following examples and aspects thereof are described and illustrated in conjunction with systems, tools, and methods that are meant to be exemplary and illustrative, not limiting in scope. In various examples, one or more of the above-described problems have been reduced or eliminated, while other examples are directed to other improvements.

It is the objective of this baby carrier to improve child carriers that are worn by an adult for carrying two babies at the same time.

It is a further objective of this baby carrier to provide a strong baby carrier that is safe and comfortable for wearer and babies.

A further objective of the this baby carrier is to provide a carrier that is versatile and can be worn by an adult with two babies that can be positioned on the front of wearer or one baby on front of wear and one on the back of wearer without significant adjustments once the carrier is configured to the desired position.

Another object of the baby carrier is to be simple to use so that wearer can quickly and easily put each baby into the baby carrier without placing baby into an individual pouch prior to attaching baby in the baby carrier.

Yet another objective of this baby carrier is to allow the wear to carry two babies of the same weight and age or two babies of different weights and ages.

A further objective of this baby carrier is to allow wearer to carry two babies up to a total weight of 50 lbs when wearing two babies or 35 lbs for an individual baby.

Another objective of this baby carrier is an adult can transport two babies in a hands free manner.

Yet another objective this baby carrier can be adjusted to accommodate for the ages and weight of babies so that wearer can have the longest possible use out of carrier.

Yet another objective this baby carrier which comprises of two padded shoulder straps; two soft fabric baby supporting pouches fixed to a padded hip belt that are dependent upon each other.

DETAILED DESCRIPTION OF DRAWINGS

In the following description, several specific details are presented to provide a thorough understanding. One skilled in the relevant art will recognize, however, that the concepts and techniques disclosed herein can be practiced without one or more of the specific details, or in combination with other components, etc. In other instances, well-known implementations or operations are not shown or described in detail to avoid obscuring aspects of various examples disclosed herein. This carrier is a soft structured baby carrier worn by an adult, wishing to carry two babies at the same time in a hands free manner. The carrier is preferable fashioned of a fabric material, such as cotton, twill or quilted fabric or any other convenient fabric. The carrier is preferable machine washable and dryable and light, weighing about 1-2 pound. The connections or coupling are defined as buckles, snap, Velcro or any other known or convenient way for fastening two points together. The strapping consists of polypropylene or nylon webbing or any other known or convenient strapping. The connection points and webbing in the art of this carrier is interchangeable with any convenient way of fastening and images and description are examples of how parts may connect together but these are not definitive methods of connecting two points.

Figure 1:
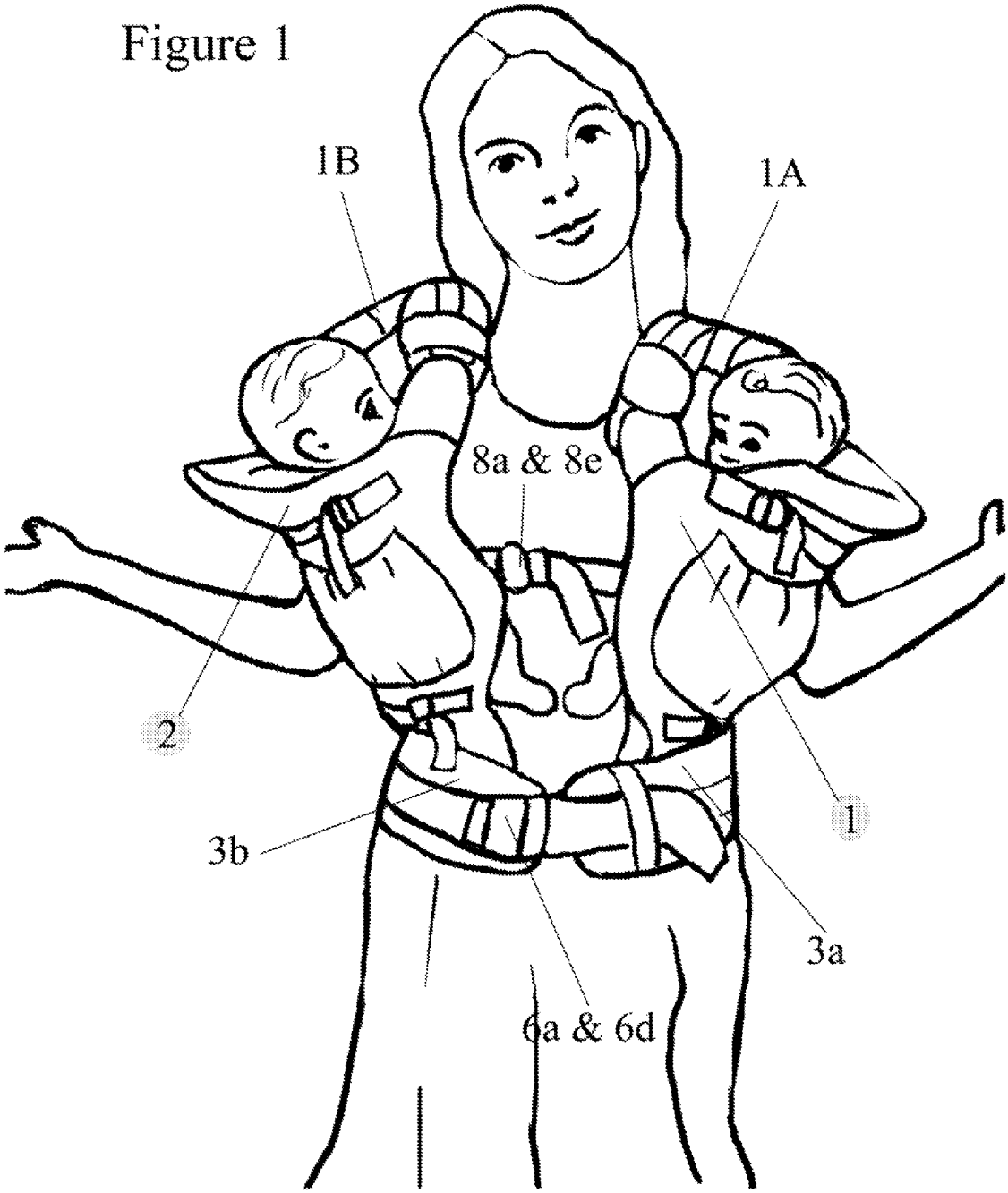
FIG. 1 depicts an example of a carrier with one adult wearer carrying two babies at the same time on the front of wearer. This is exemplary of the Front Carry Position of which is one of the four carry positions of this carrier.
Figure 7:
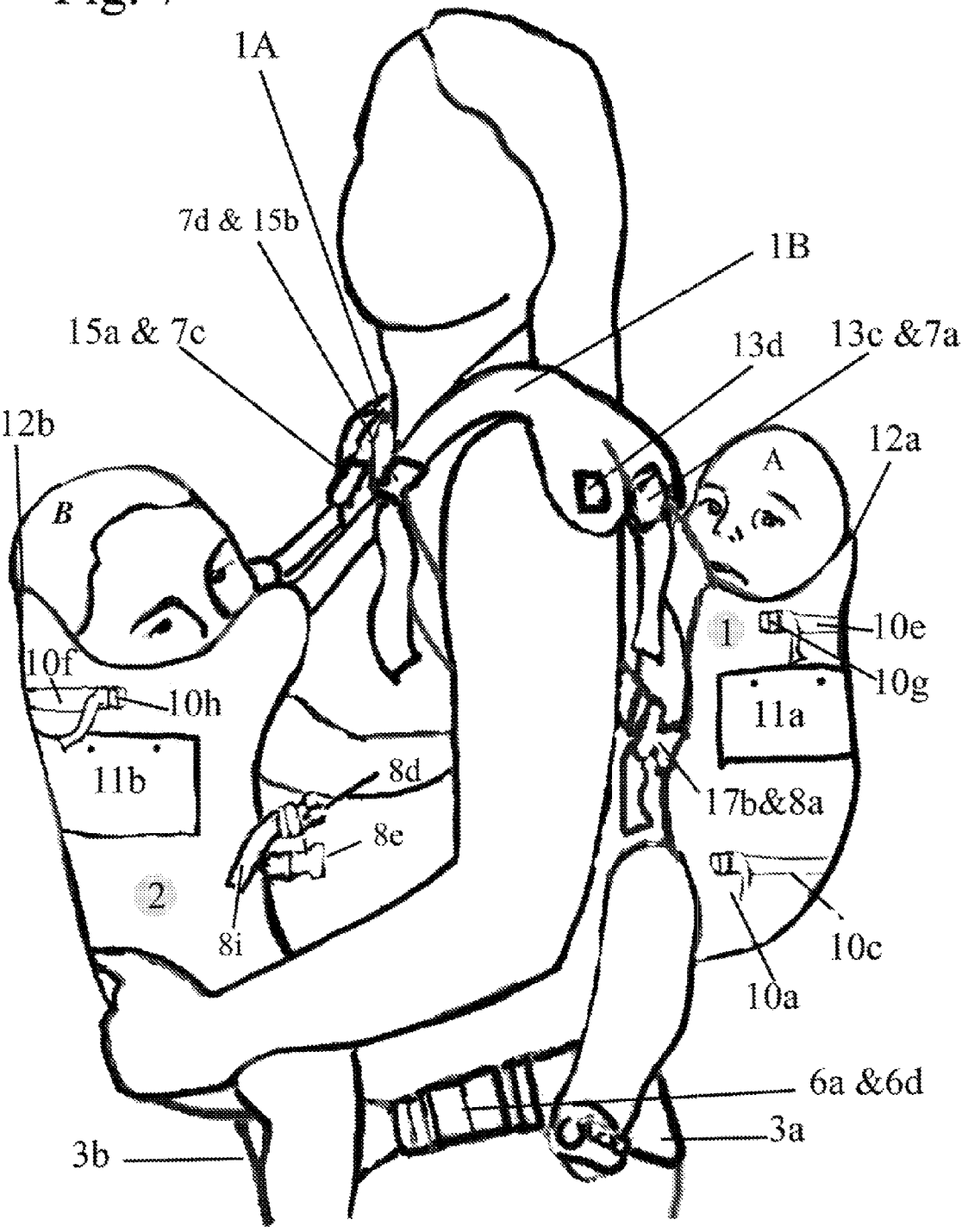
FIG. 7 depicts an example of the Front and Back Carry Position showing a baby in a Pouch facing wearer in an upright position mounted upon back of wearer and a baby in a pouch in an upright position facing wearer mounted upon the front of wearer.
Figure 9:
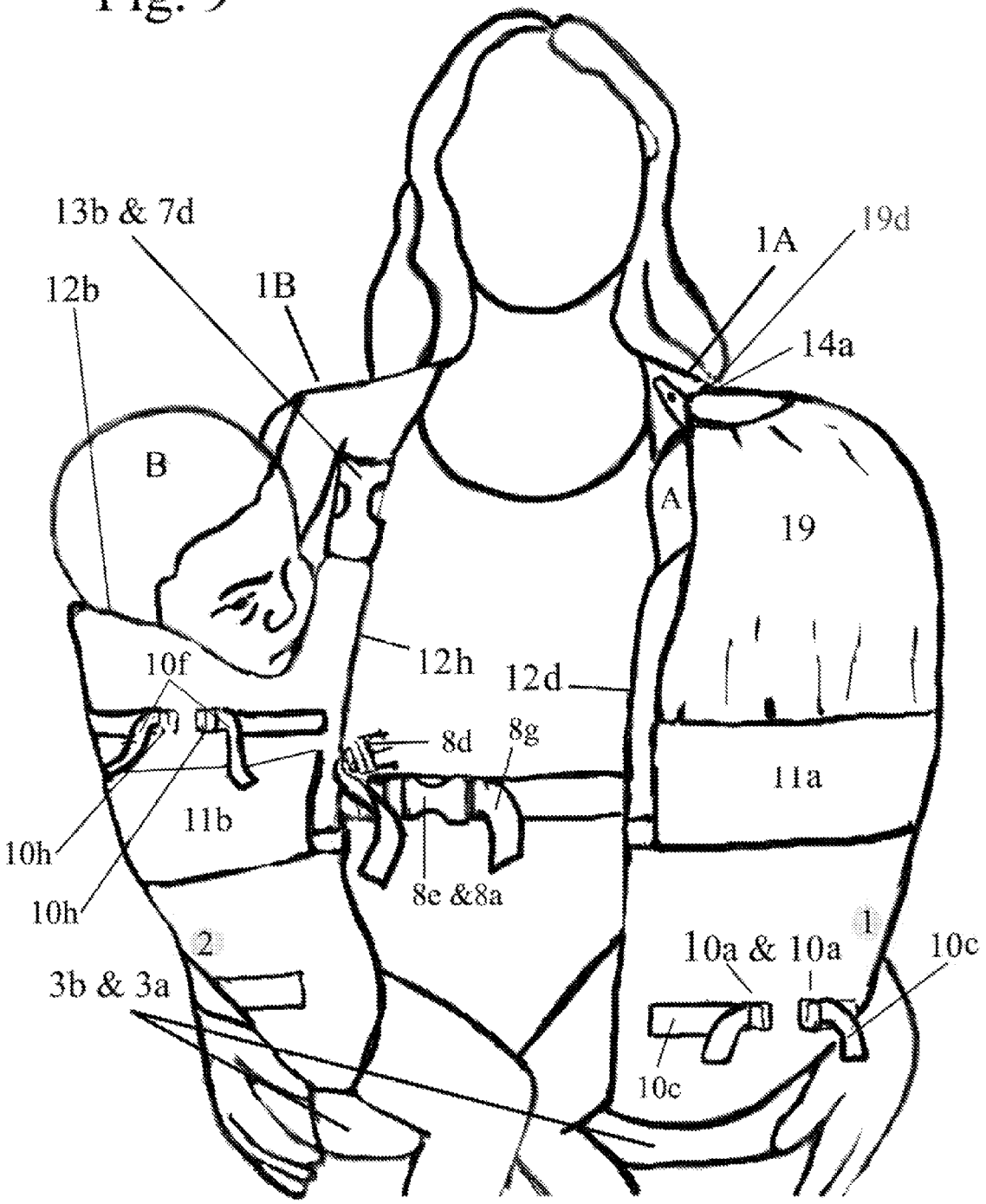
FIG. 9 depicts a perspective view of the Front Carry Position showing both babies mounted in carrier upon front of wearer with one of the babies' heads being covered by Head Cover Hood.
Figure 10:
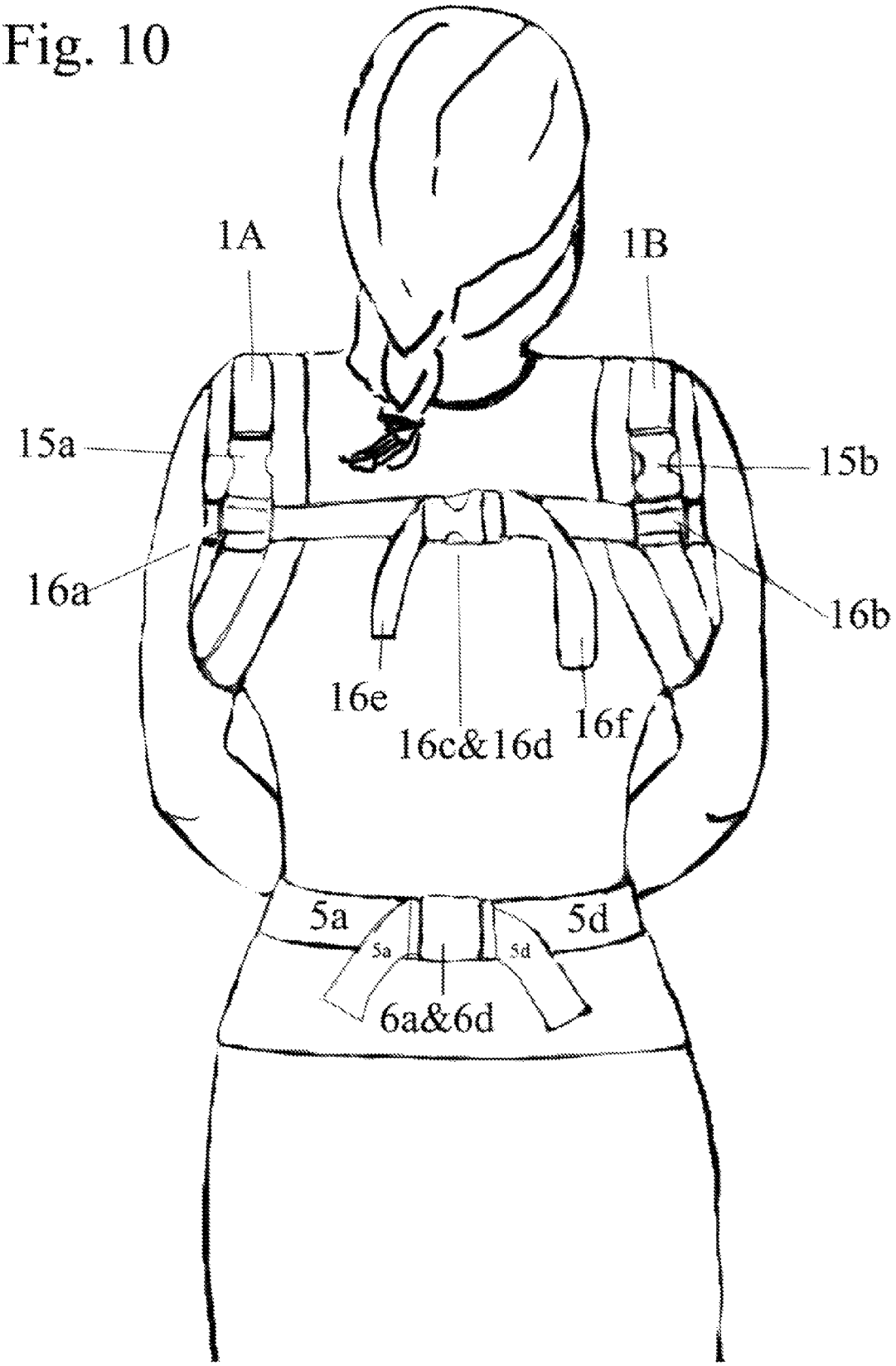
FIG. 10 Is a perspective view of the back of wearer in the Front Carry Position and Single Baby Carry position. This view illustrates how the Chest Strap connects the first and second Shoulder Straps together and how the first and second Hip Belts goes around to the back of wearer and connects together on the back of wearers' hips.
Figure 11:
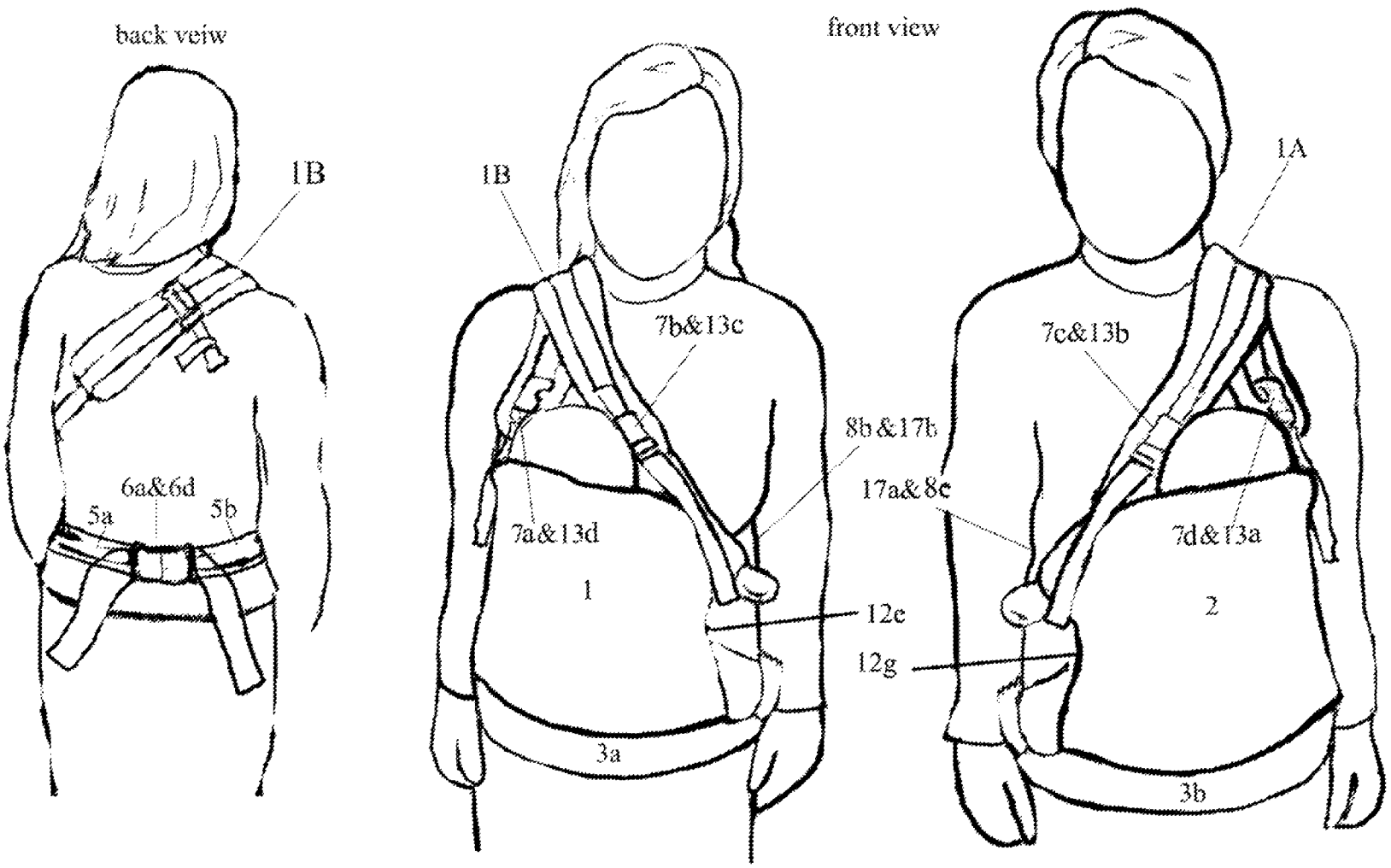
FIG. 11 Is a perspective view of the Individual Carry Position showing how the carrier can be split into two separate carriers. Each baby mounted in each individual Pouch mounted upon the front hip of one adult each.
Figure 12:
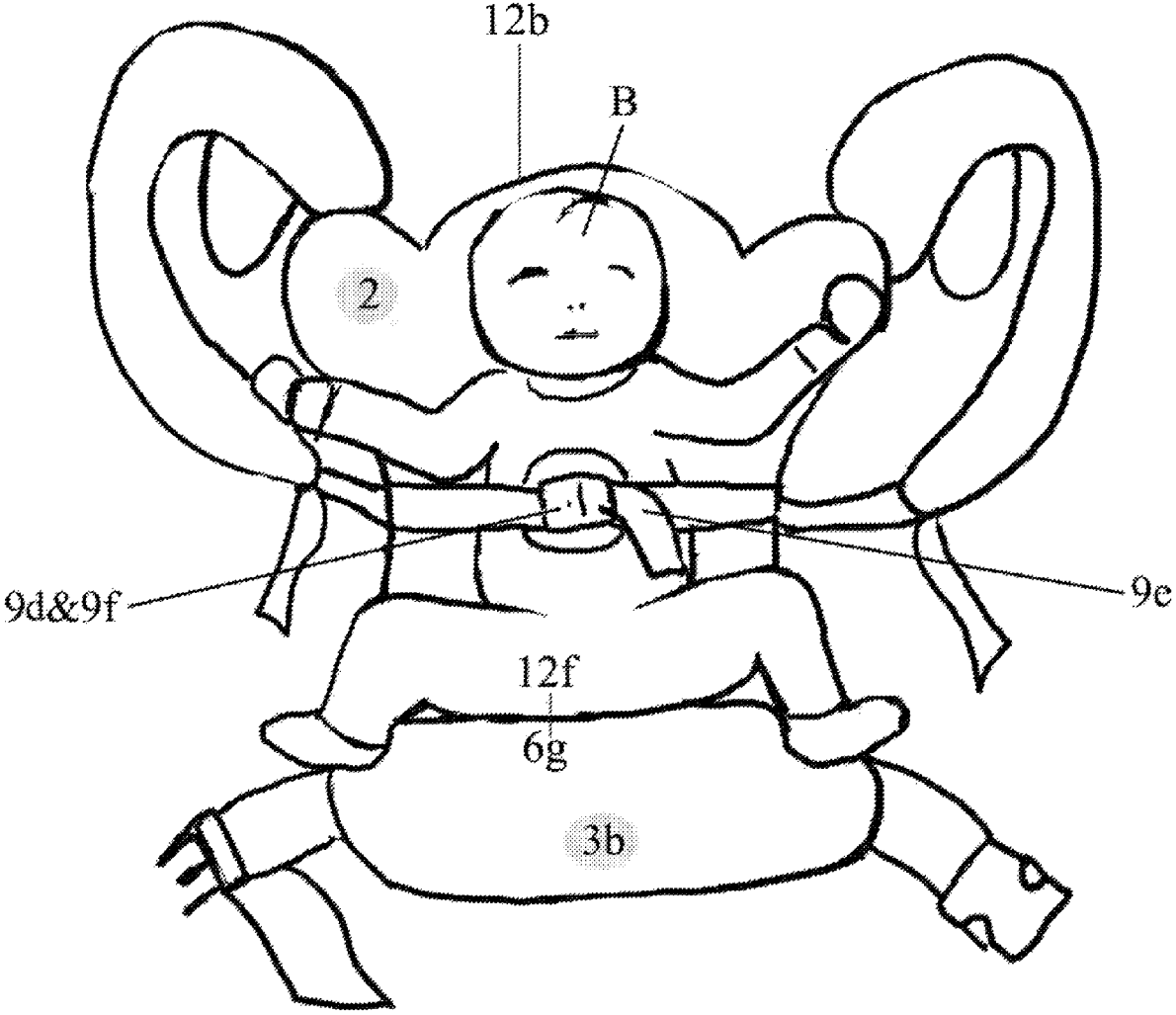
FIG. 12 depicts an exemplary view of how the Infant Safety Belt connects around baby's abdomen when mounted in one of two Pouches and that the pouch as a single panel of fabric in continuous contact with the back side of the baby.
Figure 13:
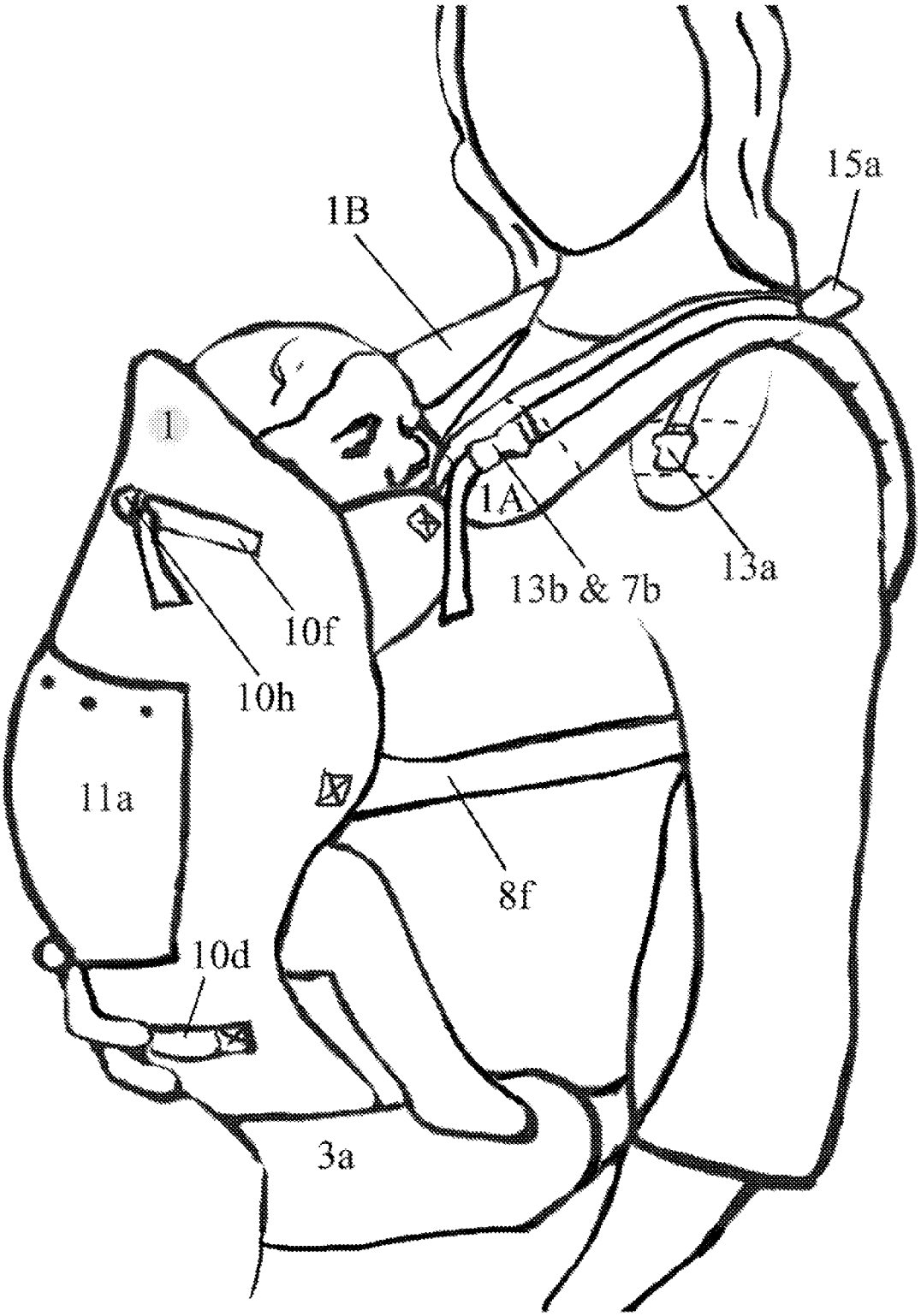
FIG. 13 is a perspective view of an adult carrying one baby in the baby carrier as the Single Baby Carry Position option using the first and second Shoulder Straps and one pouch.

There are four carrying positions for this baby carrier, in which, both babies face the wearer mounted in an upright position in a pouch and each pouch adapted to form a child carrying area in co-operation with the wearer's torso and baby is in continuous contact with the wearer's torso as seen in FIGS. 1, 7, 11, 13. The single panel of fabric used to form the pouch is exemplified in FIG. 12. FIG. 1 and FIG. 9 are an example of the Front Carry Position which two babies are worn on the front of wearer. FIG. 7 is an example of the Front and Back Carry Position in which one baby is worn on the front of wearer and one on back of wearer. FIG. 11 is an example of the Individual Carry Position in which the baby carrier is split into two baby carriers, so two adults, can carry one baby in one pouch, and each pouch, is supported by one Shoulder Strap forming two individual sling style baby carriers. FIG. 13 is an example of the Single Baby Carry Position in which one wearer can carry one baby, in a traditional soft structured buckle carrier with the baby carrier worn on the front or the back of wearer, with one baby in one pouch, supported by the first and second Shoulder Strap over each shoulder, as seen in FIG. 10, like a back pack and second Shoulder Strap are connected together between the shoulder blades by a slide-able fixed chest strap. In all four carrying positions, as shown in FIGS. 1, 7, 11 and 13 the burden of the weight of the baby is distributed between the first and second Shoulder Straps FIG. 3, the Hip Belt FIG. 5, whereby dispersing the majority of the babies weight to the hips of wearer. In all four carry positions, this baby carrier strives to be uncomplicated for the wearer to use, yet flexible with the carrying positions to grow with the needs of the baby and wearer as the ages and weights of baby varies. The first and second pouch, Pouch 1 & Pouch 2, and the hip belts are designed to support the baby's hip and spine ergonomically as can be seen in FIGS. 7, 9, and 13. The Hip Belts 3*a* and 3*b* are designed to bear the majority of the babies weight on the hips of the wearer and the first and second Shoulder Straps. Shoulder Strap 1A and Shoulder Strap 1B, are designed to be comfortable on the shoulders of a wearer to support the additional distribution of weight from the hips of wearer to the shoulders of the wearer.

Figure 8:
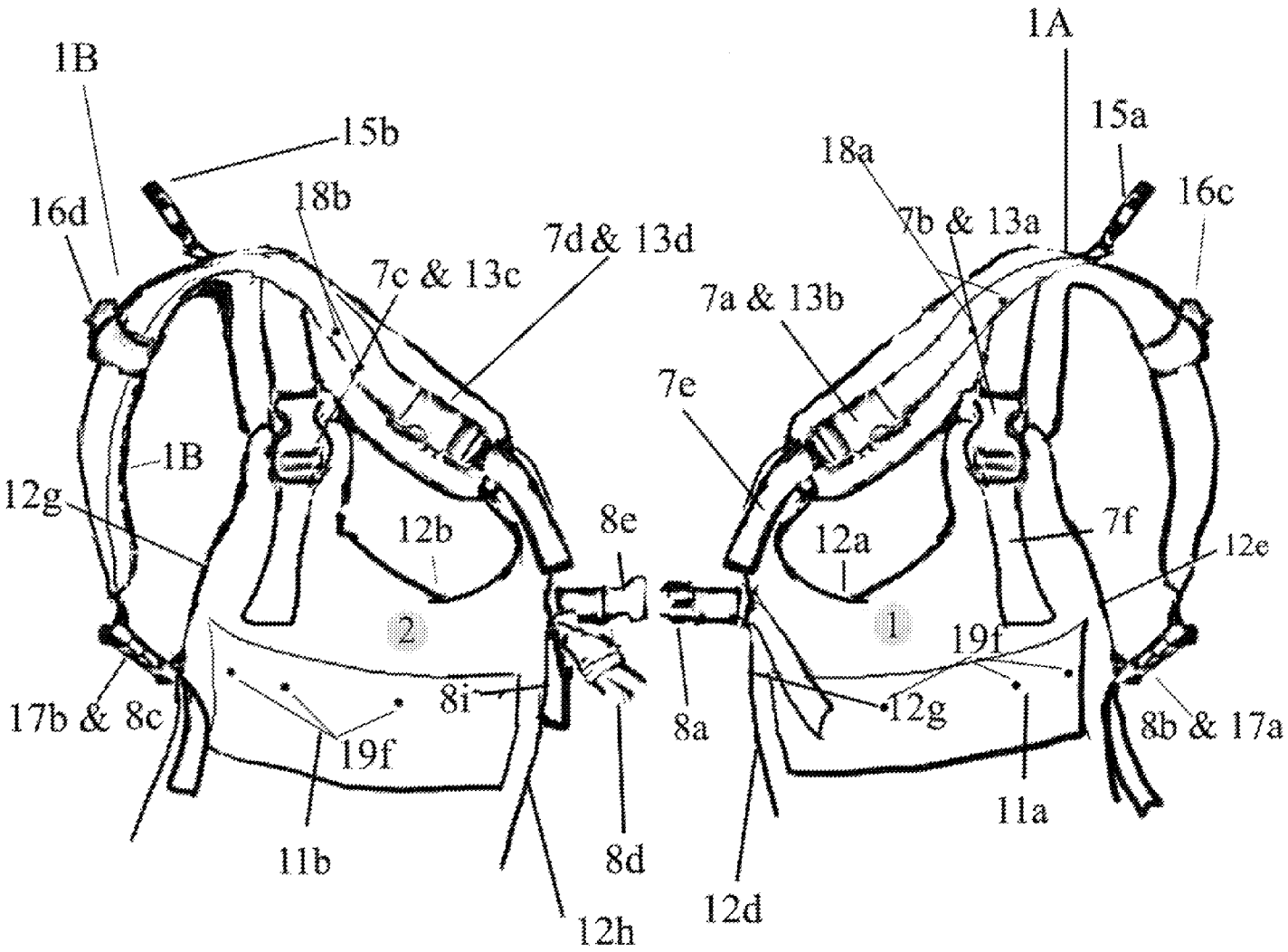
FIG. 8 depicts a detailed example of how the first and second Shoulder Straps connect to the first and second pouch in the Front Carry Position.

FIG. 1 shows the Front Carry Position as one example of the four carrying options that this baby carrier provides. The first and second Shoulder Strap, 1A and 1B, contain foam padding that runs most of the length of the Shoulder Strap and the first and second Hip Belt, 3*a* and 3*b*, contain an interior foam padding that runs most of the section of the Hip Belt. Baby A is mounted in Pouch 1 and Baby B is mounted in Pouch 2 facing the wearer. Pouch 1 Side Edge Male Buckle 8*a* couples to Pouch to Pouch Female Buckle 8*e*. The Hip Belt 3*a* and 3*b* connect together and encircle the hips of wearer and buckle together in the front of wearer where Hip Belt Female Adjustable Buckle 6*a* couples with Hip Belt Male Adjustable Buckle 6*d*. Shoulder Strap 1A supports Pouch 1 on the left shoulder of wearer and Shoulder Strap 1B supports Pouch 2 on the right shoulder of wearer. Each baby, Baby A and Baby B, are supported between the Shoulder Strap and the Hip Belt in each of the first and second pouch. The split-head of of the first and second Shoulder Strap enables one Pouch to be buckled to one Shoulder Strap as shown in the Shoulder Strap to Pouch connection detailed in Front Carry Position of FIG. 1, and FIG. 9 and detail of shoulder strap to pouch connection of the Front Carry Position as depicted in FIG. 8.

Figure 2:
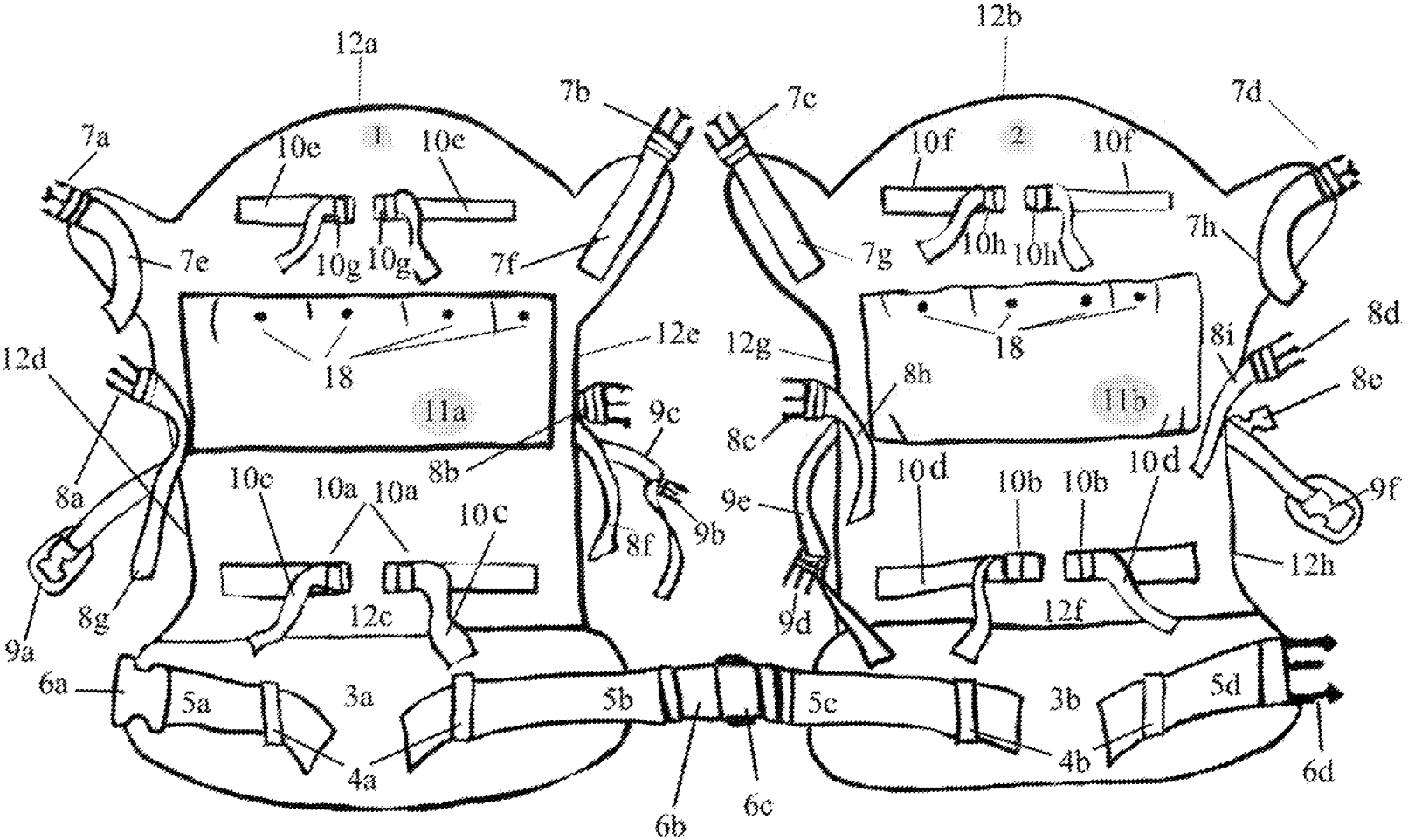
FIG. 2 depicts an example of a detailed front view of first and second pouch.

FIG. 2 depicts an example of a detailed front view of Pouch 1 and Pouch 2 with all of its elements included. It should be accepted that Pouch 1 and Pouch 2 have all these elements in other figures even if they cannot be seen or drawn. Pouch 1 is for carrying one of two babies and Pouch 2 is for carrying one of two babies. Pouch 1 Side Edge Male Buckles 8*a* is slide-able attached (slide-able attached is defined as being attached on to the strap but can slide up and down upon the strap) to Pouch 1 Side Edge Male Buckle Adjustment Strap 8*g*. Pouch 1 Side Edge Male Buckles 8*b* is slide-able attached to Pouch 1 Side Edge Male Buckle Adjustment Strap 8*f*. Pouch 2 Side Edge Male Buckles 8*c* is slide-able attached to Pouch 2 Side Edge Male Buckle Adjustment Strap 8*h*. Pouch 2 Side Edge Male Buckles 8*d* is slide-able attached to Pouch 1 Side Edge Male Buckle Adjustment Strap 8*i*. Pouch 1 Bottom Edge 12*c* is fixed to Hip Belt Top Edge 6*e*. Pouch 2 Bottom Edge 12*f* is fixed to Hip Belt Top Edge 6*g*. Hip Belt Strap 5*a* is fixed to Hip Belt 3*a* and Hip Belt Female Adjustable Buckle 6*a* is slide-able attached to Hip Belt Adjustment Strap 5*a*. On the opposite side of Hip Belt 3*a* is fixed to Hip Belt Adjustment Strap 5*b*, which is slide-able attached to Hip Belt Male Adjustable Buckle 6*b*. Hip Belt Strap 5*c* is fixed to Hip Belt 3*b* and Hip Belt Female Adjustable Buckle 6*c* is slide-able attached to Hip Belt Adjustment Strap 5*c*. On the opposite side of Hip Belt 3*b* Hip Belt Adjustment Strap 5*d* is fixed which Hip Belt Male Adjustable Buckle 6*d* slide-able attached to Hip Belt Adjustment Strap 5*d*. The Elastic Bands for Hip Belt Adjustment Straps 4*a* on Hip Belt 3*a* and Elastic Bands for Hip Belt Adjustment Straps 4*b* on Hip Belt 3*b* are used to put the loose Hip Belt Adjustment Straps after adjusting carrier. Fixed to Pouch 1 Top Edge 12*a* is Pouch 1 Top Edge Male Buckle Adjustment Straps 7*e* which Top Edge Male Buckles 7*a* is slide-able attached. Also, fixed to Pouch 1 Top Edge 12*a*, is Pouch 1 Top Edge Male Buckle Adjustment Straps 7*f* which Top Edge Male Buckles 7*b* is Slide-able attached. Fixed to Pouch 2 Top Edge 12*b* is Pouch 2 Top Edge Male Buckle Adjustment Strap 7*g* which Top Edge Male Buckles 7*c* is slide-able attached. Also, fixed to Pouch 2 Top Edge 12*a*, is Pouch 2 Top Edge Male Buckle Adjustment Straps 7*h* which Top Edge Male Buckles 7*d* is slide-able attached. Pouch 1 Infant Safety Belt Buckle 9*a* is fixed to Pouch 1 Side Edge 12*d* and Pouch 1 Infant Safety Belt Buckle 9*b* is slide-able attached to Infant Safety Belt Adjustment Strap 9*c*, which is fixed to Pouch 1 Side Edge 12*e*. Pouch 2 Infant Safety Belt Buckle 9*f* is fixed to Pouch 2 Side Edge 12*h*. Pouch 2 Safety Belt Buckle 9*d* on Pouch 2 Side Edge 12*g* is slide-able attached to Pouch 2 Safety Belt Adjustment Strap 9*e*. Towards the Top Edge of Pouch 1 and Pouch 2 are the Head Support Adjustment Straps 10*e* and 10*f* which are slide-able attached to Head Support Adjustment Buckles 10*g* and 10*h*. Towards the Bottom Edges of Pouch 1 and Pouch 2 are Newborn Adjustment Straps 10*c* and 10*d* that are slide-able attached to Newborn Adjustment Buckles 10*a* and 10*b*. Storage Pocket 11*a* is centered on the front of Pouch 1 and Storage Pocket 11*b* is centered on the front of Pouch 2. Fixed to Storage Pockets 11*a* and 11*b* Storage Pocket Head Cover Snaps 19*f*.

Figure 3:
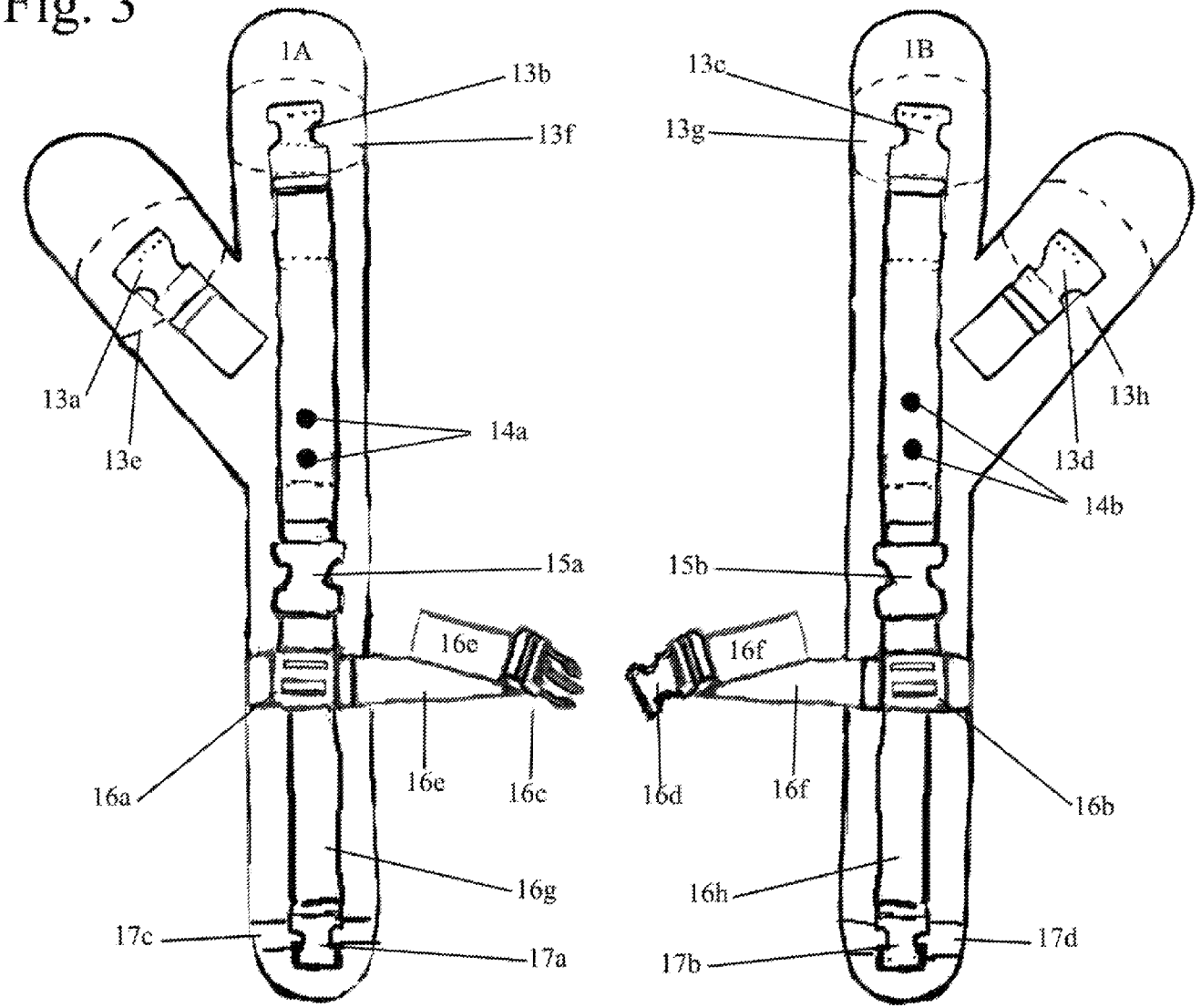
FIG. 3 depicts an example of detailed view first and second Shoulder Straps.

FIG. 3 depicts a detailed view of the first and second Shoulder Straps 1A and 1B for this carrier. It should be accepted that Shoulder Strap 1A & 1B have all these elements in other figures even if they cannot be seen or drawn. Each Shoulder Strap has a top end that has a split-double head configuration and a bottom end with a single head. Fixed on one of the top end of the split-heads of Shoulder Strap 1A is Shoulder Strap 1A Top Female Buckle's 13*a* that is covered by Buckle Cover 13*e* and fixed on the other top end of Shoulder Strap 1A is Shoulder Strap 1A Top Female Buckle's 13*b*, which is covered by Buckle Cover 13*f*. Fixed on one of the top end of the split-heads of Shoulder Strap 1B is Shoulder Strap 1B Top Female Buckle's 13*c*, which is covered by Buckle Cover 13*g* and fixed on the other top end Split-head of Shoulder Strap 1B is Shoulder Strap 1B Top Female Buckle's 13*d*, which is covered by Buckle Cover 13*h*. On Shoulder Strap 1A Hood Cover Snaps 14*a* and on Shoulder Strap 1B Hood Cover Snaps are 14*b*. The 1A Chest Strap Slider Buckle 16*a* slides upon 1A Slider Buckle Strap 16*g*. The 1B Chest Strap Slider Buckle 16*b* slides upon 1B Slider Buckle Strap 16*h*. Shoulder Strap 1A Chest Strap 16*e* loops around shoulder strap and than 1A Chest Strap Adjustable Male Buckle 16*c* is slide-able attached to Shoulder Strap 1A Chest Strap 16*e*. 1B Chest Adjustment Strap 16*f* loops around shoulder strap than 1B and Chest Strap Adjustable Female Buckle 16*d* is slide-able attached to Chest Adjustment Strap 16*f* loops. Mid way down Shoulder Strap 1A is the Front Carry Female Buckle 15*a* and mid way down Shoulder Strap 1B is the Front Carry Female Buckle 15*b*. Shoulder Strap 1A Bottom Female Buckle 17*a* is fixed to the bottom of Shoulder Strap 1A and is secured down by 1A Shoulder Strap Elastic Band 17*c*. Shoulder Strap 1B Bottom Female Buckle 17*b* is fixed on the bottom of Shoulder Strap 1B and is secured down by 1B Shoulder Strap Elastic Band 17*d*. It should be noted that the top end split-double head configuration makes it possible to support the one pouch with just one shoulder strap.

Figure 4:
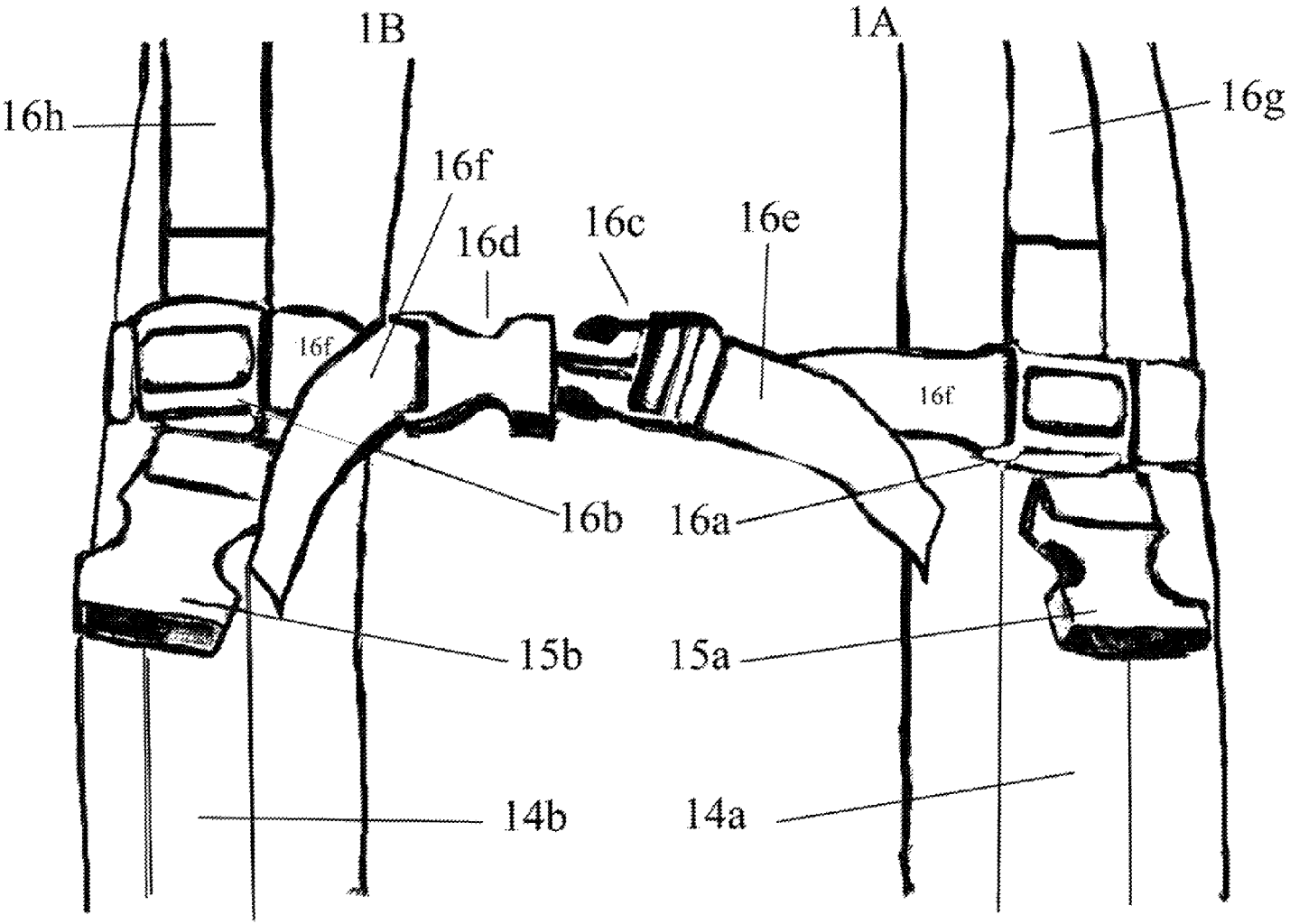
FIG. 4 depicts an example of Chest Strap.

FIG. 4 depicts a detail perspective of the chest strap which is used to connect Shoulder Strap 1A & 1B together on either the front of wearer at the chest or on the back of wearer between shoulder blades so that Shoulder Straps 1A and 1B cannot slide off shoulders of wearer. The 1A Chest Strap Slider Buckle 16*a* slides upon 1A Slider Buckle Strap 16*g*. The B Chest Strap Slider Buckle 16*b* slides upon 1B Slider Buckle Strap 16*h*. Shoulder Strap 1A Chest Strap 16*e* loops around shoulder strap than 1A Chest Strap Adjustable Male Buckle 16*c* is slide-able attached to strap. Shoulder Strap 1B Chest Strap 16*f* loops around shoulder strap than 1B Chest Strap Adjustable Female Buckle 16*d* is slide-able attached to strap. Chest Strap Slider Buckle 16*a* can than slide upon Shoulder Strap 1B Slider Buckle Strap 16*h*. The Front Carry Female Buckles are 15*a* and 15*b*, which are used in the Front and Back Carry Position.

Figure 5:
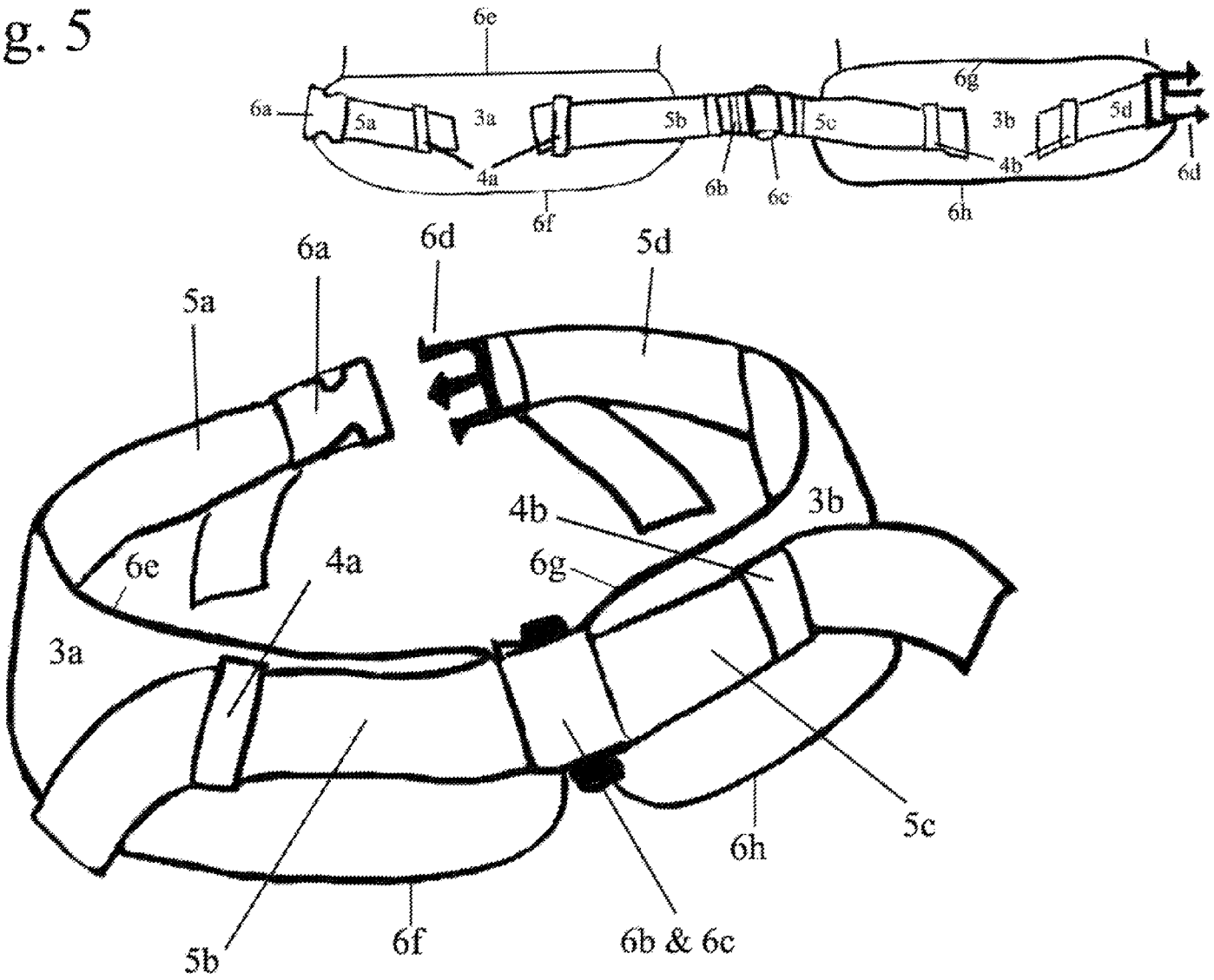
FIG. 5 depicts an example of first and second Hip Belt and how it couples together.

FIG. 5 depicts a close up view of the Hip Belts 3*a* and 3*b*. It should be noted that although this drawing of Hip Belts does not depict wearer in picture it should be accepted that this is how Hip Belt 3*a* and 3*b* couple together and encircles hips of wearer. It also should be noted that all elements of Hip Belts in other figures contain all its elements even if not depicted in the figure. Hip Belt Adjustment Strap 5*a* is fixed to Hip Belt 3*a* and Female Hip Belt Buckle 6*a* is slide-able attached to Hip Belt Adjustment Strap 5*a*. On fixed on the opposite side of Hip Belt 3*a* is Hip Belt Adjustment Strap 5*b* and slide-able attached to Hip Belt Adjustment Strap 5*b* is Hip Belt Male Buckle 6*b*. Hip Belt Strap 5*c* is fixed to Hip Belt 3*b* and is slide-able attached to Hip Female Adjustable Buckle 6*c*. Fixed to the opposite side of Hip Belt 3*b* is Hip Belt Adjustment Strap 5*d* and is slide-able attached to Hip Belt Male Adjustable Buckle 6*d*. The Elastic Bands for Hip Belt Adjustment Straps 4*a* on Hip Belt 3*a* and Elastic Bands for Hip Belt Adjustment Straps 4*b* on Hip Belt 3*b* are used to secure the loose Hip Belt Adjustment Straps after adjusting carrier. Hip Belt 3*a* has Hip Belt Top Edge 6*e* and Hip Belt Bottom Edge 6*f*. Hip Belt 3*b* has Hip Belt Top Edge 6*g* and Hip Belt Bottom Edge 6*h*. The Hip Belts should site on the wearer between the sacral area and the natural waist of wear. The Hip Belt 3*a* and 3*b* connect together and completely circles around hip's of wearer.

Figure 6:
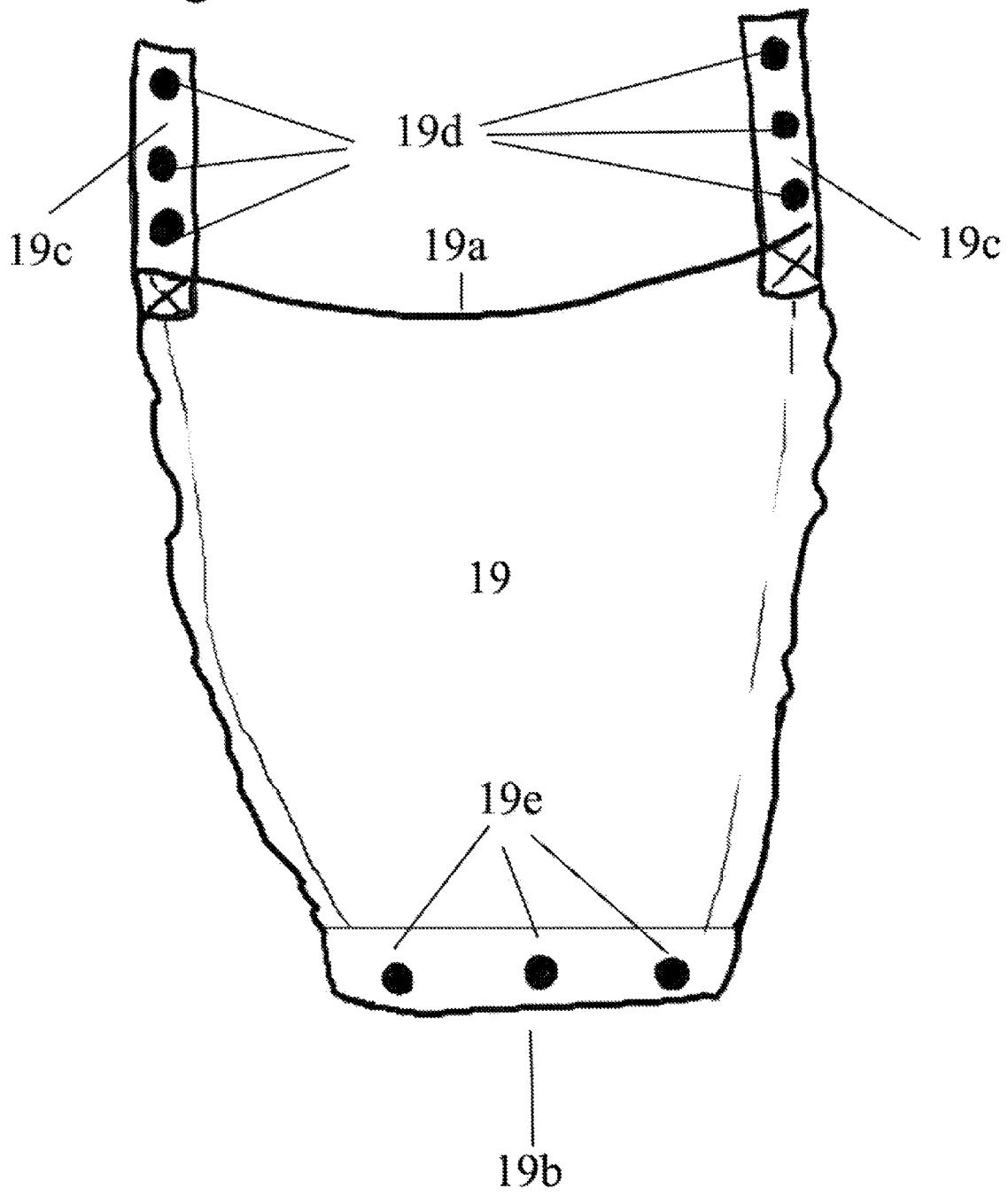
FIG. 6 depicts an example of Head Cover Hood.

FIG. 6 Depicts a detail view of Head Cover Hood 19 is rectangular shaped fabric panel that pulls over the baby's head to create cover and privacy and add additional support to head while baby is sleeping. Although not depicted in this drawing it should be accepted that there are two Head Cover Hoods 19. Head Cover Hood Snaps 19*e* are fixed to Head Cover Hood Straps 19*c* at the Top Edge of Head Cover Hood 19*a*. On the Bottom Edge of Head Cover Hood 19*b* are the Head Cover Storage Pocket Snaps 19*e*. The Head Cover Hood is used to give a baby privacy while sleeping or nursing. A Head Cover Hood is stored in Storage Pouches 11*a* and 11*b* when not in use and snaps to Storage Pouch Hood Cover Snaps 18. Head Cover Hood can be used in any of the Four Carry Positions.

FIG. 7 depicts a perspective view of the Front & Back Carry Position showing wearer carrying one baby each in Pouches 1 and 2. Pouch 2 is worn on the front of wearer and Pouch 1 is worn on the back of wearer. Flip Belt Female Adjustable Buckle 6*a* couples with Hip Belt Male Adjustable Buckle 6*d* left side of wearer on the hips. Shoulder Straps 1A, loops over wears right shoulder and Shoulder Strap 1B loops over wearers left shoulder and Shoulder Strap 1B Bottom Female Buckle 17*b* couples with Pouch 1 Side Male Buckle 8*a*. Pouch 1 Shoulder Strap 1B Top Female Buckle 13*c* couples with Pouch 1 Top Edge Male Buckle 7*a*. Shoulder Strap 1A than loops over left shoulder of wearer. Pouch 2 Top Edge Male Buckle 7*c* couples to the Front Carry Female Buckle 15*a* which, as shown in FIG. 3, is mid-way down the center line on Shoulder Strap 1A. Pouch 2 Top Edge Male Buckle 7*d* couples with the Front Carry Female Buckle 15*b* which, as shown in FIG. 3, is mid-way down the center line on Shoulder Strap 1B. Baby B's head is supported by the Pouch 2 Top Edge 12*b* and baby A's head is supported by the Pouch 1 Top Edge 12*a*. Near the Top Edge of Pouches 1 Head Support Adjustment Straps le is slide-able attached to the Head Support Adjustment Buckle 10*g*. Near the Top Edge of Pouches 2 Head Support Adjustment Straps 10*f* is slide-able attached to the Head Support Adjustment Buckle 10*h*. Towards the Bottom Edges of Pouch 1 is the Newborn Adjustment Buckle 10*a* is slide-able attached to the New Born Adjustment Straps 10*c*. Inactive in this Carry Position are Pouch 2 Side Edge Male Buckle 8*d* and the Pouch to Pouch Female buckle 8*e*. Pouch 1 Storage Pocket 11*a* is centered in on the Pouch 1 and Pouch 2 Storage Pocket 11*b* is centered in on Pouch 2.

FIG. 8 depicts a detail view of Front Carry Position shoulder strap connection. Shoulder Strap 1A Top Female Buckle 13*a* buckles to Pouch 1 Top Edge Male Buckle 7*b*. Shoulder Strap 1A Top Female Buckle 13*b* buckles to Pouch 1 Top Edge Male Buckle 7*a*. Shoulder Strap 1A than creates a loop and Shoulder Strap 1A Bottom Shoulder Strap female buckle 17*a* buckles to Pouch 1 Side Edge Male Buckle 8*b*. Shoulder Strap 1B Top Female Buckle 13*c* buckles to Pouch 2 Top Edge Male Buckle 7*b*. Shoulder Strap 1B Top Female Buckle

13*d* buckles to Pouch 2 Top Edge Male Buckle 7*d*. Shoulder Strap 1B than creates a loop and Shoulder Strap 1B Bottom Shoulder Strap Female Buckle 17*b* buckles to Pouch 1 Side Edge Male Buckle 8*c*. Pouch 1 Side Edge Male Buckle 8*a* couples to Pouch 2 Pouch to Pouch Female Buckle 8*e* to hold Pouches together. Storage Pouch Hood Cover Snaps 18 are fixed to Pouch 1 Storage Pocket 11*a* and Pouch 2 Storage Pocket 11*b*, which the Bottom Edge Head Cover Hood Snaps 19*e* snap on to.

FIG. 9 depicts the Front Carry Position with two babies worn on the front of wearer. In Pouch 1 Baby A is mounted on the front left hip of wearer facing wearer and in Pouch 2 baby B is mounted on front right hip of wearer facing wearer with Hip Belt 3*a* and Hip Belt 3*b* supporting the majority of weight from Pouch 1 and Pouch 2. Pouch 2 Side Edge 12*h* Pouch to Pouch Female Buckle 8*e* couples into Pouch 1 Side Edge Male Buckle 8*a* to hold both Pouches together. Pouch 1 Side Edge Male Buckle Adjustment Strap 8*g* can be adjusted for perfect distance between Pouches 1 and 2. Pouch 1 Head Cover Hood 19 pulls over baby's head and Head Cover Hood Snaps 19*d* snap on to 1A Flood Cover Shoulder Strap Snaps 14*a*. Pouch 2 Head Support Adjustment Straps 10*f* are slideable attached to Pouch 2 Head Support Adjustment Buckles 10*h*. On Pouch 1 New Born Adjustment Straps 10*c* are slideable attached to Pouch 1 Newborn Adjustment Buckles 10*a*. Storage pocket 11*a* is centered on the front of Pouch 1 and Storage Pocket 11*b* is centered on the front of Pouch 2. In the Front Carry Position it is easy to place each baby into each Pouch by first unbuckling Pouch 2 Top Edge Male Buckle 7*d* on Shoulder Strap 1B Top Female Buckle 13*d* and unbuckling Pouch 1 Top Edge Male Buckle 7*a* from Shoulder Strap 1A Female Buckle 13*b*. The safety belt must be put around baby A in Pouch 1 before baby B is placed into Pouch 2. Once baby B is secured into Pouch it is important, to adjust the Side Edge Pouch Adjustment Straps and the Pouch to Pouch Adjustment strap 8*g* for a secure fit. On Pouch 1 and Pouch 2, the New Born Adjustment Straps make the Pouch narrower at the base and the Pouch shorter to accommodate a smaller infant and the Head Support Adjustment Straps give a young baby the additional neck and head support it needs. The Newborn Adjustment Strap and Head Support Strap are used for babies until they reach about 12-15 lb. The Front Carry Position is mostly utilized for term newborn babies until about 4-6 months, or when babies can hold their heads up on their own.

FIG. 10 Depicts the back view of the Front Carry Position. Shoulder Strap 1A loops over the left shoulder of wearer and Shoulder Strap 1B loops over the right shoulder of wearer. 1A Chest Strap Adjustable Male Buckle 16*c* couples together with 1B Chest Strap Adjustable Female Buckle to secure Shoulder Straps 1A and 1B together. Chest Strap Adjustment Straps 16*e* and 16*f* can be adjusted for the perfect distance between the two Shoulder Straps. 1A Chest Strap Slider Buckle 16*a* and 1B Chest Strap Slider Buckle 16*b* are the Slide Buckles for the Chest Strap that slide up and down 1A Slider Buckle Strap 16*g* and 1B Slider Buckle Strap 16*h* slider strap to adjust the perfect position between straps on wearer. Pouch 1, Waist Belt Adjustment Strap 5*a* goes around wearer's waist and Hip Belt Female Adjustable Buckle 6*a* couples with Pouch 2 Hip Belt Male Adjustable Buckle 6*d* on Pouch 2 Waist Belt Adjustment strap 5*d*. The Front Carry Female Buckles 15*a* and 15*d* are not in use in this position. In the Front Carry Position the carrier waist belt is buckled around waist than shoulder straps are place over the shoulders and then connected together with the chest strap buckle between the shoulder blades.

FIG. 11 Depicts the view of the Individual Carry Position, which shows how the carrier can be split into two carriers with one wearer carrying one baby each. Pouch 1 Top Edge Male Buckle 7*a* is coupled with Shoulder Strap 1B Top Female Buckle 13*d* and Pouch 1 Top Edge Male Buckle 7*b* is coupled with Pouch 1 Top Edge Adjustable Male Buckles 13*c*. Shoulder Strap 1B crosses over right shoulder of wearer and Shoulder Strap 1B Bottom Female Buckle 17*b* buckles to Pouch 1 Side Edge Male Buckle 8*b*. Pouch 1 Hip Belt 3*a* sits on the front left hip of wearer. Pouch 2 Top Edge Male Buckle 7*c* is coupled with Shoulder Strap 1A Top Female Buckle 13*b* and Pouch 2 Top Edge Male Buckle 7*d* is coupled with Pouch 2 Top Edge Adjustable Male Buckles 13*a*. Shoulder Strap 1A crosses over the left shoulder of wearer and Shoulder Strap 1A Bottom Female Buckle 17*a* buckles to Pouch 2 Side Edge Male Buckle 8*c*. Pouch 2 Hip Belt 3*b* sits on the front left hip of wearer. Hip Belt Adjustment Straps 5*a* and 5*b* go around wearers' waist.

FIG. 12 is a perspective inside view pouch with Safety Belt and how it goes around baby's abdomen. It should be noted that this particular view is representative of how the safety belt is used in both Pouch 1 and Pouch 2. Not all elements of carrier are represented. The back of baby B is supported by Pouch 2 with babies head being supported by Pouch 2 Top Edge. The bottom of baby B is seated in Pouch 2 near Pouch 2 Bottom Edge 12*f*, which is fixed to Hip Belt 3*b* Top Edge 6*g*. Safety Belt 9*d* and 9*f* buckle together around the front baby B's abdomen. The safety belt can be than adjusted for a firm fit by adjusting the Safety Belt Adjustment Strap 9*e*. It is very important that the safety belt is utilized to prevent baby from slipping out of carrier.

FIG. 13 is a perspective view of the Single Baby Carry Position with one wearer carrying one baby on the front of wearer. Once the baby is old enough the wearer can also wear baby on the back. Shoulder Strap 1A Top Female Buckle 13*b* couples with Pouch 1 Top Edge Male Buckle 7*b*. Shoulder Strap 1A loops over the wearers left shoulder and connects to the Side Edge Male Buckle can be adjusted for comfort by adjusting Pouch 1 Side Edge Male Buckle Adjustment Strap 8*f*. Shoulder Strap 1B connects to the Top Edge of Pouch 1 and loops over right shoulder of wearer. Hip Belt 3*a* goes around the hips of wearer and buckle at the back of wearers' hips. Storage Pouch 11*a* on the front of Pouch is used for storing personal items. The Head Support Adjustment Strap 10*f* can be pulled and tightened through Head Support Adjustment Buckle 10*h* for further head support on a smaller baby. The Newborn Adjustment Strap 10*d* can also be pulled and tightened to make the bottom of the Pouch narrower and the height of Pouch shorter to accommodate the bottom and height of a smaller baby by means that the baby sits above the adjustment strap once it is tightened as depicted in FIG. 1 and FIG. 13. The adjustment straps can be adjusted for the size of baby until baby reaches a size that it doesn't need the pouch adjustments.

Detailed List of Carrier Parts: 1. Pouch 1. 1A. Shoulder Strap 1B. Shoulder Strap. 2. Pouch 2. 3*a*. Hip Belt. 3*b*. Hip Belt. 4*a*. Elastic Bands for Hip Belt Adjustment Straps. 4*b*. Elastic Bands for Hip Belt Adjustment Straps. 5*a*. Hip Belt Adjustment Strap. 5*b*. Hip Belt Adjustment Strap. 5*c*. Hip Belt Adjustment Strap. 5*d*. Hip Belt Adjustment Strap. 6*a*. Hip Belt Female Adjustable Buckle. 6*b*. Hip Belt Male Adjustable Buckle. 6*c*. Hip Belt female Adjustable Buckle. 6*d*. Hip Belt Male Adjustable Buckle. 6*e*. Hip Belt 3*a* Top Edge. 6*f*. Hip Belt 3*a* Bottom Edge. 6*g*. Hip Belt 3*b* Top Edge. 6*h*. Hip Belt 3*b* Bottom Edge. 7*a*. Pouch 1 Top Edge Male Buckle. 7*b*. Pouch 1 Top Edge Male Buckle. 7*c*. Pouch 2 Top Edge Male Buckle. 7*d*. Pouch 2 Top Edge Male Buckle. 7*e*. Pouch 1 Top Edge Male Buckle Adjustment Strap. 7*f*. Pouch 1 Top Edge Male Buckle Adjustment Strap. 7*g*. Pouch 2 Top Edge Male Buckle Adjustment Strap. 7*h*. Pouch 2 Top Edge Male Buckle Adjustment Strap. 8*a*. Pouch 1 Side Edge Male Buckle. 8*b*. Pouch 1 Side Edge Male Buckle. 8*c*. Pouch 2 Side Edge Male Buckle. 8*d*. Pouch 2 Side Edge Male Buckle. 8*e*. Pouch to Pouch Female Buckle. 8*f*. Pouch 1 Side Edge Male Buckle Adjustment Strap. 8*g*. Pouch 1 Side Edge Male Buckle Adjustment Strap. 8*h*. Pouch 2 Side Edge Male Buckle Adjustment Strap. 8*i*. Pouch 2 Side Edge Male Buckle Adjustment Strap. 9*a*. Pouch 1 infant Safety Belt Buckle. 9*b*. Pouch 1 Infant Safety Belt Buckle. 9*c*. Pouch 1 Infant Safety Belt Adjustment Strap. 9*d*. Pouch 2 Infant Safety Belt Buckle. 9*e*. Pouch 2 Infant Safety Belt Adjustment Strap. 9*f*. Pouch 2 Infant Safety Belt Buckle. 10*a*. Pouch 1 Newborn Adjustment Buckle. 10*b*. Pouch 2 Newborn Adjustment Buckle. 10*c*. Pouch 1 Newborn Adjustment Strap. 10*d*. Pouch 2 Newborn Adjustment Strap. 10*e*. Pouch 1 Head Support Adjustment Strap. 10*f*. Pouch 2 Head Support Adjustment Strap. 10*g*. Pouch 1 Head Support Adjustment Buckle. 10*h*. Pouch 2 Head Support Adjustment Buckle. 11*a*. Pouch 1 Storage Pocket. 11*b*. Pouch 2 Storage Pocket. 12*a*. Pouch 1 Top Edge. 12*b*. Pouch 2 Top Edge. 12*c*. Pouch 1 Bottom Edge. 12*d*. Pouch 1 Side Edge. 12*e*. Pouch 1 Side Edge. 12*f*. Pouch 2 bottom edge. 12*g*. Pouch 2 side edge. 12*h*. Pouch 2 side edge. 13*a*. Shoulder Strap 1A top female buckle. 13*b*. Shoulder Strap 1A top female buckle. 13*c*. Shoulder Strap 1B top female buckle. 13*d*. Shoulder Strap 1B top female buckle. 13*e*. Buckle Cover. 13*f*. Buckle Cover. 13*g*. Buckle Cover. 13*h*. Buckle Cover. 14*a*. 1A Hood Cover Shoulder Strap Snaps. 14*b*. 1B Hood Cover Shoulder Strap Snaps. 15*a*. Front Carry Female Buckle. 15*b*. Front Carry Female Buckle. 16*a*. 1A Chest Strap Slider Buckle. 16*b*. 1B Chest Strap Slider Buckle. 16*c*. 1A Chest Strap Adjustable Male Buckle. 16*d*. 1B Chest Strap Adjustable Female Buckle. 16*e*. 1A Chest Adjustment Strap. 16*f*. 1B Chest Adjustment Strap. 16*g*. 1A Slider Buckle Strap. 16*b*. 1B Slider Buckle Strap. 17*a*. Shoulder Strap 1A Bottom Female Buckle. 17*b*. Shoulder Strap 1B Bottom Female Buckle. 17*c*. 1A Shoulder Strap Elastic Band. 17*d*. 1B Shoulder Strap Elastic Band. 18. Storage Pouch Head Cover Hood Snaps. 19. Head Cover Hood. 19*a*. Top Edge of Head Cover Hood. 19*b*. Bottom Edge of Head Cover Hood. 19C. Head Cover Hood Straps. 19*d*. Head Cover Hood Snaps. 19*e*. Bottom Edge Head Cover Hood Snaps.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A baby carrier to be worn by a wearer for carrying twins or two babies close in age comprising:

a first and second pouch, each having an upwardly curved top edge, side edges and a bottom edge; wherein each pouch is adapted to form a child carrying area with the wearer's torso; wherein each of the babies is in continuous contact with the wearer's torso; and wherein the bottom edge of each pouch is fixed to a top edge of a hip belt; wherein each of the first and second pouches can be releasably connected together in a front carry position by pouch to pouch buckles; wherein the first and second pouch each further include newborn adjustment straps and newborn adjustment buckles, which run horizontally across the bottom region of the first and second pouch; wherein the first and second pouch each include a head support adjustment strap and a head support adjustment buckle that run horizontally across the top region of the first and second pouch; wherein each of the first and second pouch further comprise an infant safety belt fixed to each of the side edges of each of the first and second pouches; wherein the first and second pouch each further comprise an infant safety belt buckle for use around each baby's abdomen to prevent slippage from the first and second pouch;

the hip belt comprising a first and second hip belt, wherein the first and second hip belt each further comprise a top edge, a bottom edge and two opposing side edges; wherein each hip belt side edge includes a first hip belt adjustment strap and a slide-able attached buckle on each first hip belt adjustment strap; wherein each of the first and second hip belt each further include elastic bands used to secure loose portions of the first hip belt adjustment straps after adjusting each of the first and second hip belt; wherein each of the first and second hip belt has second hip belt adjustment straps and adjustable buckles that are fixed to each opposing side edge of each of the first and second hip belt, the second hip belt adjustment strap adjustable buckles being able to couple the first and second hip belt thereby encompassing the hips of wearer; and a first shoulder strap having a split-head and a second shoulder strap having a split head, each of which minimizes a number of buckles and adjustment straps, permits the use of a first and second hip belt, and permits the use of heavy padding in the first and second split-head shoulder straps, while still allowing the baby carrier to be used in more than two carry positions; wherein the first and second shoulder straps each include a first and second top end buckle at a top end area of each of the first and second shoulder straps, a bottom end buckle at a bottom end area of each of the first and second shoulder straps, and a front carry female buckle positioned midway down a centerline of each of the first and second shoulder straps; each of the first and second top end buckles being covered by a buckle cover;

a chest strap that is slide-able, secured and releasable and connects each first and second shoulder strap together on the front or back of the wearer;

a first and second head cover hood having a rectangular shaped fabric panel; and wherein hips of the babies are supported in an ergonomic position in all carrying positions and a weight of each baby is distributed on the wearer by the first and second shoulder strap to the hip belt; wherein the first and second shoulder straps of the baby carrier can be configured in four carry positions including a front carry position; a front and back carry position; an individual carry position, and a single baby carry position; wherein the front carry position is defined as carrying two babies worn on a front of the wearer with one baby in each pouch; wherein the front and back carry position is defined as one baby mounted in one pouch on a front of the wearer and one baby in a pouch on a back of the wearer; wherein the individual carry position is defined as the split of the baby carrier into two baby carriers so two wearers can each carry one baby in a pouch on the front of each wearer in a sling style position; wherein the single baby carry position is defined as configuring the baby carrier with the first and second shoulder straps on one pouch with one baby worn on one wearer;

wherein in the front and back carry position the first baby is in the first pouch worn on the back of the wearer and the second baby is worn in the second pouch on the front of the wearer; and wherein the babies are secured to the wearer in the first and second pouch between the shoulder straps and directly opposite one another when both babies are secured to the shoulder straps in the first and second pouch; wherein the first hip belt having an adjustable length positioned to be securely worn about the waist of the wearer and each opposing side connecting to the opposite sides of the second hip belt; wherein the first and second shoulder strap is configured having an adjustable length forming a loop over each of the wearers shoulders; wherein a top end of the first shoulder strap is coupled to a first pouch first side top edge buckle and a bottom end of the first shoulder strap is coupled to a first pouch right side edge; wherein a top end of the second shoulder strap is coupled to a first pouch second side top edge buckle and a bottom end of the second shoulder strap is coupled to a first pouch left side edge; wherein the front carry female buckles respectively connect to second pouch first and second top edge buckles on the front of the wearer;

wherein when the baby carrier is in said individual carry position for use by two adults, each pouch and shoulder strap form two sling style baby carriers; wherein the first shoulder strap's first and second top end buckles each couple to the first and second top edge buckles of the first pouch, the first shoulder strap crosses over one shoulder of the first wearer, the first shoulder strap crosses over the back of the first wearer and the bottom of the first shoulder strap buckles to the side edge of the first pouch, and the hip belt of said first pouch encompasses the hips of the wearer; wherein the second shoulder strap's first and second top end buckles each couple to the first and second top edge buckles of the second pouch, the second shoulder strap crosses over one shoulder of the second wearer, the second shoulder strap crosses over the back of the second wearer and the bottom of the second shoulder strap buckles to the side edge of the second pouch, and the hip belt of said second pouch encompasses the hips of the second wearer.

2. The baby carrier of claim 1, wherein all male and female buckles are interchangeable and may be fixed or slide-able and may be replaced by any convenient means for fastening two parts together.

3. The baby carrier of claim 1, wherein the upwardly curved top edge of each pouch provides head support for each baby and the bottom edge region of the pouch provides ergonomic hip support for the baby; wherein the head support adjustment buckle adjustment straps can be tightened to add additional neck and head support and narrow the width of the head area and the newborn adjustment straps can be tightened to make the pouch narrower at the bottom of the pouch and the height of pouch shorter while still maintaining an ergonomic position for the baby's hips and legs; wherein the newborn adjustment strap and head support strap are used for babies until they reach about 12-15 pounds.

4. The baby carrier of claim 1, wherein the chest strap functions to couple together the first and second shoulder strap thereby preventing the first and second shoulder strap from sliding off of the wearer by maintaining good contact with a shoulder of the wearer.

5. The baby carrier of claim 1, wherein the hip belt includes an interior foam padding that runs along most of the hip belt and distributes a substantial portion of the weight of each of the babies in each pouch to the hips of the wearer through the hip belt; wherein the hip belt encompasses the hips of the wearer whether configured as a single pouch or configured as a first and second pouch coupled together.

6. The baby carrier of claim 1, wherein each shoulder strap includes a heavily padded section, that runs throughout each shoulder strap, for supporting and distributing the weight of each baby in each of the first and second pouch.

7. The baby carrier of claim 1 wherein the head cover hood can be secured to one or both shoulder straps when pulled over a baby's head for privacy and additional head support.

8. The baby carrier of claim 1, further comprising a storage pocket disposed outside of each of the first and second pouch in which the head cover hood is removably fixed to a top edge of the storage pocket and said storage pocket is useful to store personal items.

9. The baby carrier of claim 1 wherein each of the first and second shoulder straps connects to the first and second pouch at the top edge and the side edge of the pouch; thereby the pouch and associated hip belt of the baby carrier functions to work with a single split-head shoulder strap with the purpose of carrying one baby in each first and second pouch in an ergonomic position with the baby's legs and bottom straddling the wearers hips.

10. The baby carrier of claim 1 wherein the baby carrier may or may not utilize all the baby carry position options.

11. The baby carrier of claim 1 wherein the baby carrier is adapted in said front carry position to be used to carry two babies on the front of the wearer such as is mostly utilized for term newborn babies until about 4-6 months old; wherein the first shoulder strap top end first and second buckles buckle to first and second top edge pouch buckles of the first pouch; and wherein the first shoulder strap loops over a shoulder of the wearer and buckles to the adjacent side edge of the first pouch; wherein the second shoulder strap top end first and second buckles buckle to first and second top edge pouch buckles of the second pouch and the second shoulder strap loops over the shoulder and buckles to the adjacent side edge of the second pouch; wherein the first and second shoulder straps are connected together between the shoulder blades of the wearer by the chest strap; wherein the first and second pouch are buckled together by a pouch to pouch buckle on a front of the wearer and the first and second hip belts connect together and encompass the hips of the wearer; wherein the first and second baby face the wearer in an upright position with legs straddling the front hip area of the wearer; wherein the top edge, first buckle on each pouch can be un-buckled to easily place a baby into the first or second pouch.

12. The baby carrier of claim 1 wherein the baby carrier is adapted in the single baby carry position to allow the wearer to selectively support the baby in a position facing the wearer's torso with the baby supported ergonomically in the pouch when carrying only one baby is desired; wherein the first shoulder trap buckles to a first buckle on the top edge of the first pouch and the second shoulder strap buckles to a second top edge buckle of the first pouch and each shoulder strap having an adjustable length forming a loop over each shoulder of the wearer and buckling to the adjacent side edge of the first pouch under the arms of the wearer; wherein the first and second shoulder straps are connected together between the shoulder blades by the chest strap.

* * * * *